US010429141B2

(12) United States Patent
Tobin et al.

(10) Patent No.: US 10,429,141 B2
(45) Date of Patent: Oct. 1, 2019

(54) COOLING TOWER FILL STRUCTURES

(71) Applicants: Karl Anthony Tobin, Huntsville, TX (US); Charles Augustus Peterson, II, Randleman, NC (US)

(72) Inventors: Karl Anthony Tobin, Huntsville, TX (US); Charles Augustus Peterson, II, Randleman, NC (US)

( * ) Notice: Subject to any disclaimer, the term of this patent is extended or adjusted under 35 U.S.C. 154(b) by 258 days.

(21) Appl. No.: 15/656,814

(22) Filed: Jul. 21, 2017

(65) Prior Publication Data

US 2019/0024993 A1 Jan. 24, 2019

(51) Int. Cl.
*F28F 25/08* (2006.01)
*F28F 25/06* (2006.01)

(52) U.S. Cl.
CPC ..... *F28F 25/08* (2013.01); *F28F 25/06* (2013.01); *F28F 25/082* (2013.01)

(58) Field of Classification Search
CPC ..... F28F 25/06; F28F 25/08; F28F 25/082
USPC ..... 261/111, DIG. 11
See application file for complete search history.

(56) References Cited

U.S. PATENT DOCUMENTS 4,439,378 A * 3/1984 Ovard ..... F28F 25/082 261/111
4,663,092 A * 5/1987 Kinney, Jr. ..... F28F 25/082 261/111
4,705,653 A * 11/1987 Stackhouse ..... F28F 25/082 261/111
4,915,877 A * 4/1990 Shepherd ..... F28F 25/082 261/111
5,185,105 A 2/1993 Peterson
5,460,755 A * 10/1995 Bosman ..... B01J 19/32 261/100
6,083,441 A * 7/2000 Ptaschek ..... F28F 25/082 261/111
7,618,026 B2 * 11/2009 Armstrong ..... F28F 25/082 261/111
RE41,723 E * 9/2010 Olson ..... F28F 25/082 261/111
8,020,837 B2 9/2011 Byrne

* cited by examiner

*Primary Examiner* — Charles S Bushey
(74) *Attorney, Agent, or Firm* — MP Patents, LLC

(57) ABSTRACT

A splash bar for use in a cooling tower includes bottom, top, first side and second side portions. The bottom portion has first and second edges and is configured to be supported by horizontal hanger support members of a splash bar hanger grid along a width between the first and second edges. The top portion has first and second edges and is arranged substantially parallel with the bottom portion. The first side portion extends from the first edge of the bottom portion to the first edge of the top portion and the second side portion extends from the second edge of the bottom portion to the second edge of the top portion. The first and second edges of the top portion are closer to one another than the first and second edges of the bottom portion. A plurality of openings are formed through each portions.

19 Claims, 3 Drawing Sheets

COOLING TOWER FILL STRUCTURES

SUMMARY

The disclosure seeks to provide a splash bar for use in a cooling tower, and including a bottom portion, a top portion, a first side portion and a second side portion. The bottom portion has first and second edges and is configured to be supported by horizontal hanger support members of a splash bar hanger grid along a width between the first and second edges. The top portion has first and second edges and is arranged substantially parallel with the bottom portion. The first side portion extends from the first edge of the bottom portion to the first edge of the top portion. The second side portion extending from the second edge of the bottom portion to the second edge of the top portion. The first and second edges of the top portion are closer to one another than the first and second edges of the bottom portion. A plurality of openings are formed through each of the bottom portion, the top portion, the first side portion and the second side portion.

The disclosure further seeks to provide a splash bar for use in a cooling tower, and including a bottom portion, a top portion, a first side portion and a second side portion. The bottom portion has an planar outer surface oriented in a first direction, the planar outer surface of the bottom portion being defined between first and second edges. The top portion is arranged substantially parallel with the bottom portion and has an planar outer surface oriented in a second direction opposite from the first direction, the planar outer surface of the top portion being defined between first and second edges. The first side portion extends from the first edge of the bottom portion to the first edge of the top portion while the second side portion extends from the second edge of the bottom portion to the second edge of the top portion. The first and second side portions are not parallel. A plurality of openings are formed through each of the bottom portion, the top portion, the first side portion and the second side portion.

The disclosure also seeks to provide a cooling insert for use with a cooling tower. The cooling insert includes a plurality of tubular splash bars each having a bottom portion with first and second edges, a top portion arranged substantially parallel with the bottom portion and having first and second edges. A first side portion extends from the first edge of the bottom portion to the first edge of the top portion. A second side portion extending from the second edge of the bottom portion to the second edge of the top portion. The first and second side portions are not parallel. A plurality of openings are formed through each of the bottom portion, the top portion, the first side portion and the second side portion. A hanger grid configured for support inside the cooling tower, includes a plurality of vertical hanger support members and a plurality of horizontal hanger support members connected to the vertical hanger support members to form a matrix of splash bar compartments. A plurality of the splash bar compartments receive at least one of the plurality of tubular splash bars with the bottom portions thereof resting on the horizontal hanger support members and extending therebetween.

BRIEF DESCRIPTION OF THE FIGURES

The summary above, as well as the following detailed description of illustrative embodiments, is better understood when read in conjunction with the appended drawings. For the purpose of illustrating the present disclosure, example constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

DETAILED DESCRIPTION

Figure 1:
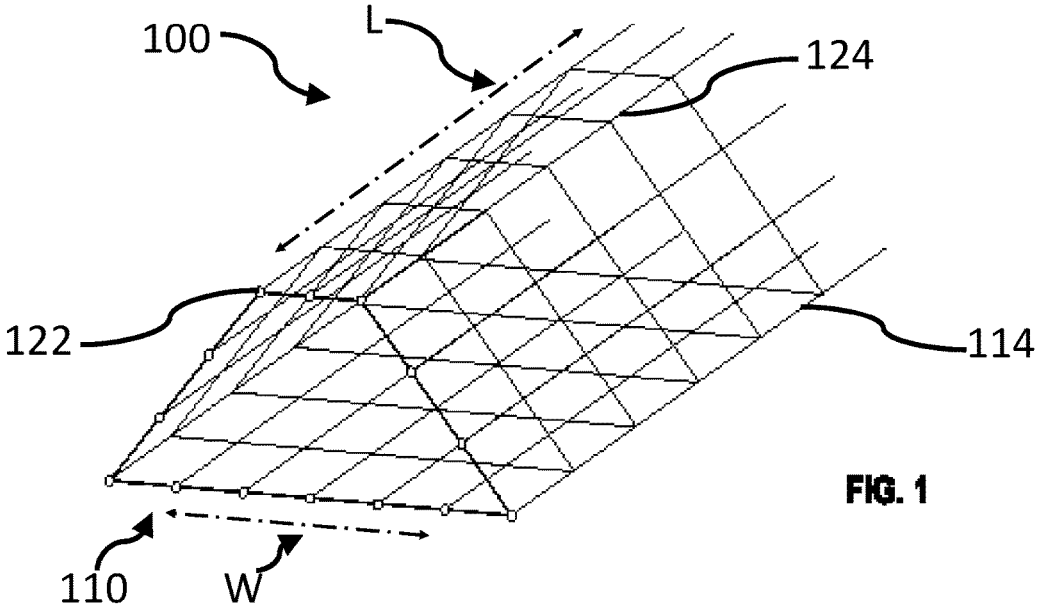
FIG. 1 illustrates a perspective view of an example splash bar in accordance with the disclosure.

The following detailed description illustrates embodiments of the disclosure and manners by which they can be implemented. Although the best mode of carrying out the disclosed fill structures and components thereof is described herein, those skilled in the art would recognize that other embodiments for carrying out or practicing the disclosure are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Cooling towers used to reject waste heat from various industrial processes include an upper hot water distribution system and an underlying collection basin. A splash type water-dispersing fill structure is provided between the hot water distribution system and collection basin. The fill structure includes a number of elongated, horizontally arranged splash bars supported at spaced intervals by a hanger grid structure. Hot water delivered to the distribution system falls and is dispersed into droplet form by the fill structure. Air currents drawn through the fill structure cool the water by evaporation. Splash bars rest on and between horizontal hanger support members of the hanger grid structure normally spaced at about 61-152 cm (24-60 in). This spacing of horizontal hanger support members is small enough for known splash bars supported thereby to withstand the force of heated water raining-down onto the splash bars.

When horizontal spacing distance between the horizontal hanger support members is increased to above 152 cm (60 in), known splash bars sag along their length under the force of heated water raining down. This results in a loss of effectiveness in breaking up the raining heated water.

The disclosed splash bar extends the horizontal spacing distance between the horizontal support members while maintaining its effectiveness for dispersing falling water drops.

Embodiments of the disclosure substantially eliminate, or at least partially address, problems in the prior art. Example disclosed splash bar embodiments exhibit sufficient strength to resist sagging along their length when used with a hanger grid having horizontal hanger support members spaced apart at a horizontal spacing distance greater than 152 cm (60 in)

advantageously saving installation time and material costs. In an example, hanger grid horizontal hanger support members may be spaced 157 cm (62 in). According to another advantage, example splash bar embodiments disclosed herein are more easily manufactured than prior art splash bars.

Additional aspects, advantages, features and objects of the disclosure will be made apparent from the drawings and the detailed description of the illustrative embodiments construed in conjunction with the appended claims that follow. Splash bars and water-dispersing fill structures in accordance with embodiments of the disclosure are hereafter described with reference to FIGS. 1-5.

Figure 2:
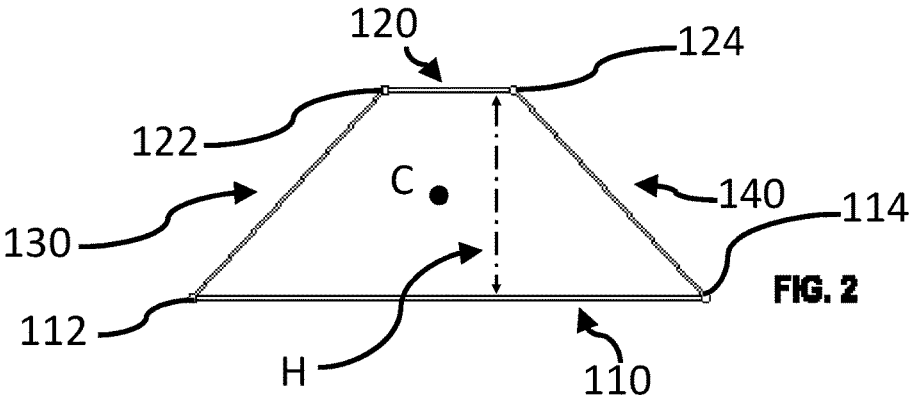
FIG. 2 illustrates a front view of the example splash bar of FIG. 1.
Figure 3:
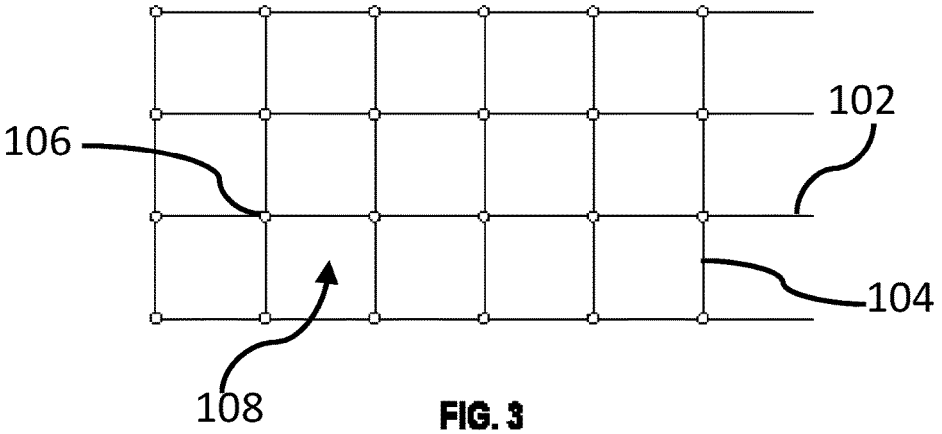
FIG. 3 illustrates a side view of the example splash bar of FIG. 1.

Referring to FIGS. 1 & 2, an example splash bar includes a tubular splash bar body which may have a lattice structure with a number of openings formed therethrough. The splash bar body exhibits length L, width W and height H dimensions which are mutually perpendicular.

As described in greater detail below in the context of a method of use, example splash bars, including the bottom, top, first side and second side portions may be formed from a number of axial or longitudinal strands 102 (FIG. 3) coupled together with a plurality of perimeter or circumferential strands 104 at a number of intersections 106 to form a lattice structure.

Referring to FIGS. 1 & 2, Bottom portion 110 has a first edge 112 and a second edge 114 and is configured to be supported by horizontal hanger support members of a splash bar hanger grid along width W between first and second edges 112 and 114. In an example, bottom portion 110 has a non-arcuate outer surface. In a further example, bottom portion 110 has an planar outer surface defined between first 112 and second 114 edges and oriented in a first direction. In a still further example bottom portion 110 may be planar in cross section (FIG. 2).

Top portion 120 has a first edge 122 and a second edge 124 and is arranged substantially parallel with bottom portion 110. For example, top portion 120 may appear to be parallel with bottom portion 110 to the naked eye and/or may diverge from parallel by up to about 1-2 degrees. In an example, top portion 120 has a substantially non-arcuate outer surface with substantially zero curvature or an effectively infinite radius of curvature. In an example, top portion 120 has an planar outer surface defined between first 122 and second 124 edges and is oriented in a second direction opposite from the first direction. In a still further example, top portion 120 may also be planar in cross section (FIG. 2).

First side portion 130 extends from first edge 112 of bottom portion 110 to first edge 122 of top portion 120. Second side portion extends from second edge 114 of bottom portion 110 to second edge 124 of top portion 120. The first and second opposing side portions 130 and 140 interconnect top and bottom portions 120 and 110 at respective first and second edges. Further, top and bottom portions 120 and 110 may be said to span the opposing side portions 130 and 140. In an example, first and second edges 122 and 124 of top portion 120 are spaced equally distant from a center C of splash bar 100 and first and second edges 112 and 114 of bottom portion 110 are also spaced equally distant from the center C of splash bar 100. A hollow passageway is defined between the bottom, top and first and second sides and so as to extend in the length direction L.

In an example, first and second side portions 130 and 140 are not parallel. In another example, respective ones of opposing side portions 130 and 140 may extend from bottom portion 110 inwardly in width dimension W and upwardly in height dimension H such that each side portion 130 and 140 extends at an acute angle relative to bottom portion 110 to terminate at top portion 120. In still another example, an angle formed by side portion 130 and bottom portion 110 is substantially equal to and opposite an angle formed by side portion 140 with bottom portion 110.

The angle defined between first side portion 130 and bottom portion 110 may be between about 35 degrees and about 55 degrees while an angle defined between second side portion 140 and bottom portion 110 may also be between about 35 degrees and about 55 degrees. In a further example, the angle defined between first side portion 130 and bottom portion 110 may be between about 40 degrees and about 50 degrees while an angle defined between second side portion 140 and bottom portion 110 may also be between about 40 degrees and about 50 degrees. In a still further example, the angle defined between first side portion 130 and bottom portion 110 may be about 45 degrees while an angle defined between second side portion 140 and bottom portion 110 may also be about 45 degrees.

In an example, first and second edges or corner longitudinal strands 122 and 124 of top portion 120 are closer to one another than first and second edges or corner longitudinal strands 112 and 114 of bottom portion 110. First and second edges 122 and 124 of top portion 120 may be about twice as close to one another as first and second edges 112 and 114 of bottom portion 110 are to one another such that the width of top portion 120 may be about 50% of the width of bottom portion 110. In a further example, first and second edges 122 and 124 of top portion 120 may be about three times as close to one another as first and second edges 112 and 114 of bottom portion 110 are to one another such that the width of top portion 120 may be about 33% of the width of bottom portion 110. In a still further example, first and second edges 122 and 124 of top portion 120 may be about four times as close to one another as first and second edges 112 and 114 of bottom portion 110 are to one another such that the width of top portion 120 may be about 25% of the width of bottom portion 110.

Figure 4:
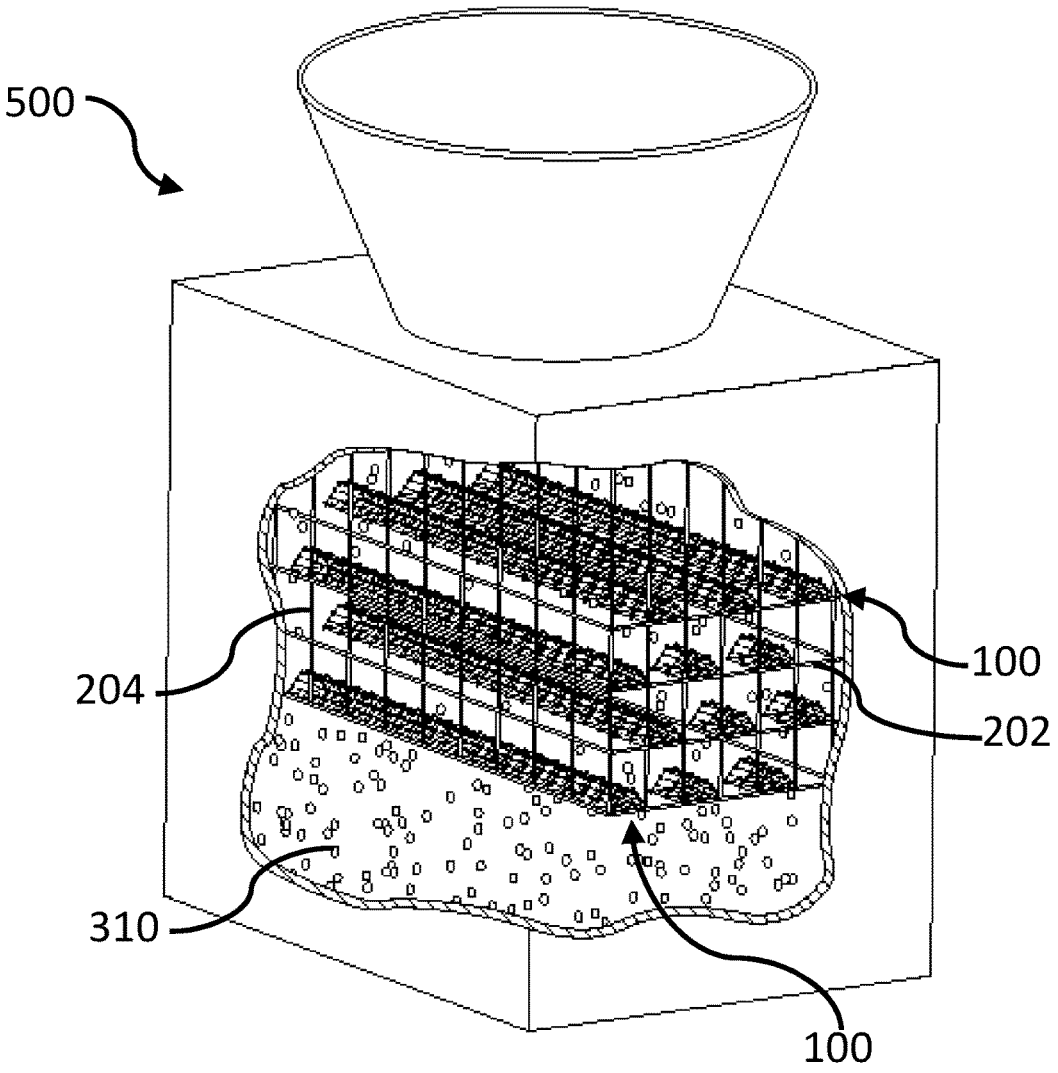
FIG. 4 illustrates example splash bars installed in an example cooling tower in accordance with the disclosure.

An example cooling tower 500 is illustrated in FIG. 4. A hanger grid comprised of a number of horizontal hanger support members 202 and a number of vertical hanger support members 204 is supported inside cooling tower 500. Vertical hanger support members 204 are attached at an upper portion of cooling tower 500 and horizontal hanger support members 202 are coupled to vertical hanger support members 204 to form a matrix of splash bar compartments configured to receive individual splash bars 100. In an example, individual splash bars 100 are horizontally inserted into alternating vertical and horizontal splash bar compartments.

During cooling, heated water rains downwardly from the upper portion of cooling tower 500 and contacts splash bars 100 which function to break up the downwardly-raining heated water to enhance the cooling effect of cross-flow or counter-flow air.

Figure 5:
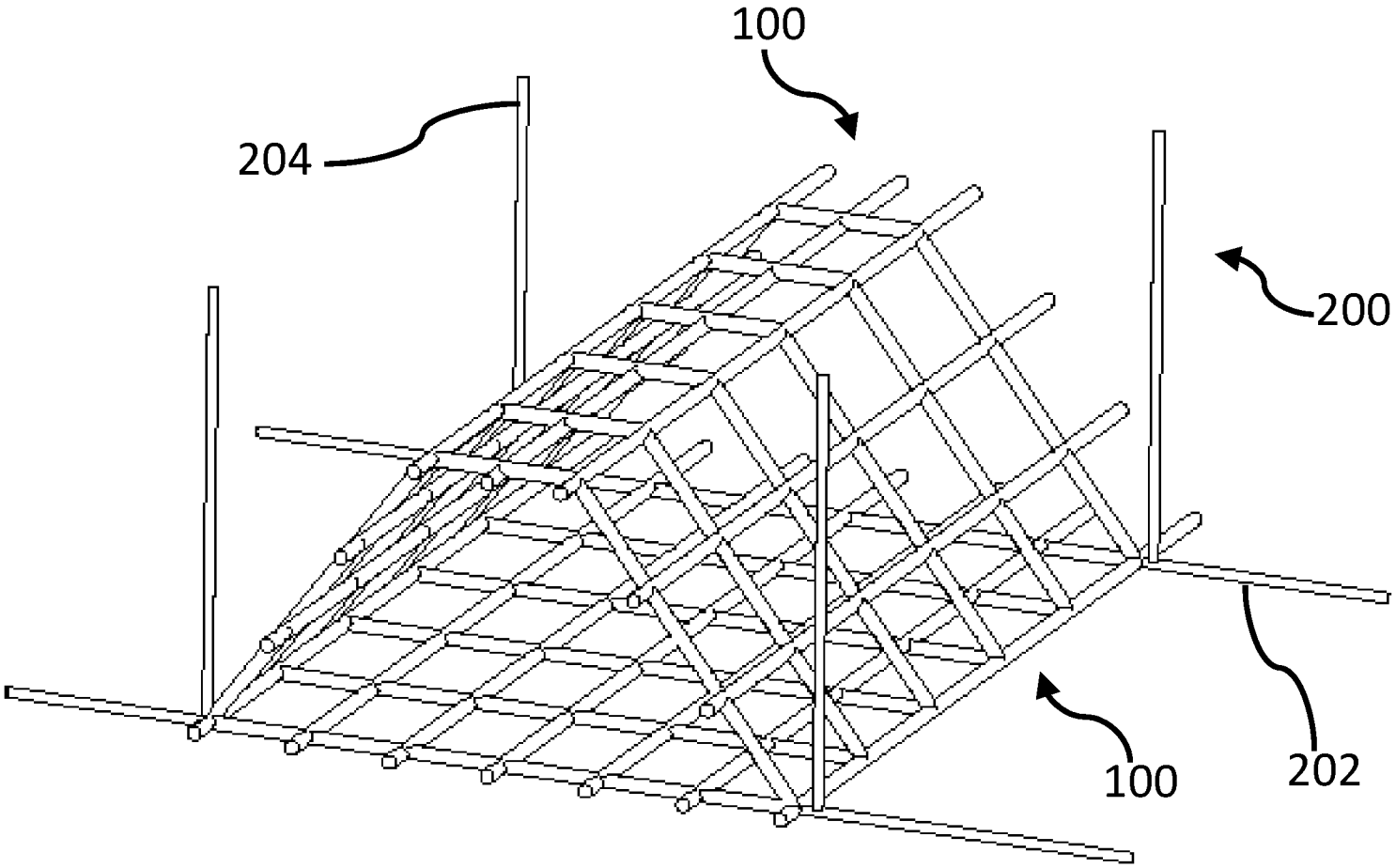
FIG. 5 illustrates an example splash bar resting on a hanger grid in accordance with the disclosure.

Referring to FIGS. 4 and 5, an example water-dispersing fill structure for use with a cooling tower includes a plurality of tubular splash bars 100 and a hanger grid 200. Each tubular splash bar 100 has a bottom portion 110 having first and second edges 112 and 114, a top portion 120 arranged substantially parallel with bottom portion 110 and having first and second edges 122 and 124, a first side portion 130 extending from first edge 112 of bottom portion 110 to first edge 122 of top portion 120, a second side portion 140 extending from second edge 114 of bottom portion 110 to second edge 124 of top portion 120. A plurality of openings 108 are formed through each of bottom portion 110, top portion 120, first side portion 130 and second side portion 140. First 130 and second 140 side portions are not parallel.

Horizontal hanger support members 202 are spaced apart at a horizontal spacing distance enabling resting of splash bars 100 thereon to span two or more horizontal hanger support members 202. Vertical hanger support members 204 are spaced apart at a vertical spacing distance which is sufficient to receive a splash bar therebetween with bottom portion edges of the splash bar adjacent to or contacting vertical hanger support members 204. In an example, the vertical spacing distance is slightly larger than 10 cm (4 in.) while a width of the splash bar is less than the vertical spacing distance or is about 10 cm (4 in.).

Referring to FIG. 5, hanger grid 200 is configured for support inside a cooling tower and includes a plurality of vertical hanger support members 202 and a plurality of horizontal hanger support members 202 connected to vertical hanger support members 204 to form a matrix of splash bar compartments configured to receive tubular splash bars such as tubular splash bars 100. For example, bottom portion 110 of splash bar 100 rests on and across horizontal hanger support members 202 which are spaced greater than about 152 cm (60 in). The disclosed splash bars are configured to withstand the force of the raining-down heated water at this and still further distances.

In an example method of use, a plurality of splash bars are formed so as to have a bottom portion having first and second edges, a top portion arranged substantially parallel with the bottom portion and having first and second edges, a first side portion extending from the first edge of the bottom portion to the first edge of the top portion, a second side portion extending from the second edge of the bottom portion to the second edge of the top portion so as to not be parallel with the first side portion. A number of openings are formed through each of the bottom portion, the top portion, the first side portion and the second side portion. In an example, the splash bars are formed from the bottom, top and first and second side portions and openings are subsequently formed therethrough.

In another example, the splash bars, including the bottom, top, first side and second side portions are formed from a number of axial strands 102 coupled together by a plurality of perimeter or circumferential strands 104 at a number of intersections 106 to form a lattice structure. The plurality of axial strands 102 are spaced apart from one another and extend in the length direction L and the plurality of perimeter strands 104 are spaced apart from one another and extend generally perpendicularly to the axial strands thereby forming a number of openings 108 which may be, for example, rectangular.

With a plurality of splash bars formed as described above or otherwise provided, a splash bar can then be installed to each of a number of splash bar compartments of a hanger grid such that the splash bar bottom portions rest on horizontal support members of the hanger grid. In an example, the bottom portions rest flush with the horizontal support members such that the bottom portions contact the horizontal support members along the entire width of the bottom portions between the first and second side portions.

It will be appreciated that features of the disclosure are susceptible to being combined in various combinations without departing from the scope of the disclosure as defined by the appended claims.

Embodiments of the disclosure are susceptible to being used for various purposes, including, though not limited to, enabling users to break up heated water raining down in a cooling tower while advantageously saving installation time and material costs by increasing horizontal hanger support member spacing to greater than 152 cm (60 in).

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim the disclosure are intended to be construed in a non-exclusive manner, namely allowing for items, components or elements not explicitly described also to be present. Reference to the singular is also to be construed to relate to the plural.

What is claimed is:

1. A splash bar for use in a cooling tower, comprising:

a bottom portion having first and second edges and configured to be supported by horizontal hanger support members of a splash bar hanger grid along a width between the first and second edges;

a top portion having first and second edges and being arranged substantially parallel with the bottom portion;

a first side portion extending from the first edge of the bottom portion to the first edge of the top portion;

a second side portion extending from the second edge of the bottom portion to the second edge of the top portion;

wherein the first and second edges of the top portion are closer to one another than the first and second edges of the bottom portion; and a plurality of openings formed through each of the bottom portion, the top portion, the first side portion and the second side portion.

2. The splash bar as set forth in claim 1, wherein the first and second edges of the top portion are spaced equally distant from a center of the splash bar and the first and second edges of the bottom portion are spaced equally distant from the center of the splash bar.

3. The splash bar as set forth in claim 1, wherein the bottom portion comprises an outer surface directed away from the top portion and wherein the outer surface of the bottom portion is substantially non-arcuate.

4. The splash bar as set forth in claim 1, wherein the bottom portion comprises an outer surface directed away from the top portion and wherein the outer surface of the bottom portion is planar.

5. The splash bar as set forth in claim 1, wherein an angle defined between the first side portion and the bottom portion is between about 35 degrees and about 55 degrees and an angle defined between the second side portion and the bottom portion is between about 35 degrees and about 55 degrees.

6. The splash bar as set forth in claim 1, wherein an angle defined between the first side portion and the bottom portion is between about 40 degrees and about 50 degrees and an angle defined between the second side portion and the bottom portion is between about 40 degrees and about 50 degrees.

7. The splash bar as set forth in claim 1, wherein an angle defined between the first side portion and the bottom portion is about 45 degrees and an angle defined between the second side portion and the bottom portion is about 45 degrees.

8. The splash bar as set forth in claim 1, wherein the first and second edges of the top portion are twice as close to one another as the first and second edges of the bottom portion are to one another.

9. The splash bar as set forth in claim 1, wherein the first and second edges of the top portion are three times as close to one another as the first and second edges of the bottom portion are to one another.

10. The splash bar as set forth in claim 1, wherein the first and second edges of the top portion are four times as close to one another as the first and second edges of the bottom portion are to one another.

11. A splash bar for use in a cooling tower, comprising:

a bottom portion having a planar outer surface oriented in a first direction, the planar outer surface of the bottom portion being defined between first and second edges;

a top portion arranged substantially parallel with the bottom portion and having a planar outer surface oriented in a second direction opposite from the first direction, the planar outer surface of the top portion being defined between first and second edges;

a first side portion extending from the first edge of the bottom portion to the first edge of the top portion;

a second side portion extending from the second edge of the bottom portion to the second edge of the top portion;

wherein an angle defined between the first side portion and the bottom portion is between about 35 degrees and about 55 degrees and an angle defined between the second side portion and the bottom portion is between about 35 degrees and about 55 degrees; and a plurality of openings formed through each of the bottom portion, the top portion, the first side portion and the second side portion.

12. The splash bar as set forth in claim 11, wherein the angle defined between the second side portion and the bottom portion is between about 40 degrees and about 50 degrees.

13. The splash bar as set forth in claim 11, wherein the angle defined between the first side portion and the bottom portion is about 45 degrees and the angle defined between the second side portion and the bottom portion is about 45 degrees.

14. The splash bar as set forth in claim 11, wherein the first and second edges of the top portion are twice as close to one another as the first and second edges of the bottom portion are to one another.

15. The splash bar as set forth in claim 11, wherein the first and second edges of the top portion are three times as close to one another as the first and second edges of the bottom portion are to one another.

16. The splash bar as set forth in claim 11, wherein the first and second edges of the top portion are four times as close to one another as the first and second edges of the bottom portion are to one another.

17. A water-dispersing fill structure for use with a cooling tower, the water-dispersing fill structure comprising:

a plurality of tubular splash bars each having:

a bottom portion having first and second edges;

a top portion having first and second edges and being arranged substantially parallel with the bottom portion;

a first side portion extending from the first edge of the bottom portion to the first edge of the top portion;

a second side portion extending from the second edge of the bottom portion to the second edge of the top portion;

wherein the first and second edges of the top portion are closer to one another than the first and second edges of the bottom portion; and a plurality of openings formed through each of the bottom portion, the top portion, the first side portion and the second side portion; and a hanger grid configured for support inside the cooling tower, the hanger grid including a plurality of vertical hanger support members and a plurality of horizontal hanger support members connected to the vertical hanger support members to form a matrix of splash bar compartments, a plurality of the splash bar compartments housing at least one of the plurality of tubular splash bars with the bottom portions thereof resting on the horizontal hanger support members and extending therebetween.

18. The water-dispersing fill structure as set forth in claim 17, wherein the bottom portion comprises an outer surface directed away from the top portion and wherein the outer surface of the bottom portion is non-arcuate.

19. The water-dispersing fill structure as set forth in claim 17, wherein the first and second edges of the bottom portion and the first and second edges of the top portion are provided as longitudinal strands.

* * * * *